US011739533B2

(12) United States Patent
Borsoi et al.

(10) Patent No.: US 11,739,533 B2
(45) Date of Patent: Aug. 29, 2023

(54) CONTROL DEVICE FOR THE LIGHTING ELEMENTS TO BE MOUNTED ON A ROLLER COVERING INSTALLATION

(71) Applicant: Teleco Automation S.r.l., Treviso (IT)

(72) Inventors: Luigi Borsoi, Treviso (IT); Roberto Collovini, Treviso (IT)

(73) Assignee: TELECO AUTOMATION S.R.L., Treviso (IT)

( * ) Notice: Subject to any disclaimer, the term of this patent is extended or adjusted under 35 U.S.C. 154(b) by 108 days.

(21) Appl. No.: 16/634,860

(22) PCT Filed: Aug. 3, 2018

(86) PCT No.: PCT/IB2018/055839
§ 371 (c)(1),
(2) Date: Jan. 28, 2020

(87) PCT Pub. No.: WO2019/026032
PCT Pub. Date: Feb. 7, 2019

(65) Prior Publication Data

US 2020/0208408 A1 Jul. 2, 2020

(30) Foreign Application Priority Data

Aug. 4, 2017 (IT) ..... 102017000090501

(51) Int. Cl.
*E04F 10/06* (2006.01)
*F21S 9/02* (2006.01)
(Continued)

(52) U.S. Cl.
CPC ..... *E04F 10/0659* (2013.01); *E04F 10/0618* (2013.01); *E04F 10/0666* (2013.01);
(Continued)

(58) Field of Classification Search
CPC ..... E04F 10/0659; E04F 10/0618; E04F 10/0666; E04F 10/0611; F21S 9/02; F21V 23/0435; F21V 33/006
See application file for complete search history.

(56) References Cited

U.S. PATENT DOCUMENTS 6,068,008 A * 5/2000 Caldwell ..... A45B 23/00 135/143
8,009,433 B2 * 8/2011 Ares ..... E06B 9/72 361/752

(Continued)

FOREIGN PATENT DOCUMENTS

AU 20144200269 5/2016
EP 0916781 5/1999

(Continued)

OTHER PUBLICATIONS

Clement, FR 2808047 machine translation, retrieved from https://worldwide.espacenet.com/publicationDetails/biblio?CC=FR&NR=2808047A1&KC=A1&FT=D&ND=3&date=20011026&DB=&locale=en_EP (Year: 2001).*

(Continued)

*Primary Examiner* — Abe Massad
(74) *Attorney, Agent, or Firm* — Carmel Patent Agency; Robert J. Ballarini

(57) ABSTRACT

A control device for lighting elements to be mounted on a roller covering installation, which includes a support structure constraining the covering installation to an outer fixed structure, a rotatable tubular shaft supported by the structure, a covering to be rolled and unrolled on the tubular shaft, and a plurality of lighting elements applied to at least one component of the roller covering, includes a casing, configured to be inserted and accommodated in the tubular shaft, and having therein a power supply for the lighting elements, a control unit for the lighting elements, which can be (Continued)

connected wirelessly and/or wired to the lighting elements of the roller covering installation, and a receiver connected to and/or incorporated in the control unit for receiving control signals from the outside and control the lighting elements accordingly.

18 Claims, 2 Drawing Sheets

(51) Int. Cl.

| | |
|---|---|
| ***F21V 23/04*** | (2006.01) |
| ***F21V 33/00*** | (2006.01) |
| *F21Y 115/10* | (2016.01) |
| *E06B 9/68* | (2006.01) |

(52) U.S. Cl.
CPC ..... *F21S 9/02* (2013.01); *F21V 23/0435* (2013.01); *F21V 33/006* (2013.01); *E06B 2009/6827* (2013.01); *E06B 2009/6863* (2013.01); *F21Y 2115/10* (2016.08)

(56) References Cited

U.S. PATENT DOCUMENTS

| | | | | |
|---|---|---|---|---|
| 8,659,246 | B2 * | 2/2014 | Mullet | E06B 9/40 160/310 |
| 8,723,455 | B2 * | 5/2014 | Mullet | E06B 9/72 160/310 |
| 9,133,662 | B2 * | 9/2015 | Nocito | E06B 9/42 |
| 9,587,431 | B2 * | 3/2017 | Choo | E06B 9/72 |
| 9,745,797 | B2 * | 8/2017 | Mullet | E06B 9/72 |
| 9,765,568 | B2 * | 9/2017 | Colson | E06B 9/78 |
| 9,834,986 | B2 * | 12/2017 | Bohlen | E06B 9/42 |
| 2007/0240832 | A1 * | 10/2007 | Cavarec | E04F 10/0651 160/70 |
| 2008/0212294 | A1 * | 9/2008 | Ares | H01Q 1/44 361/752 |
| 2010/0269988 | A1 * | 10/2010 | Mullet | E06B 9/72 160/310 |
| 2013/0058074 | A1 * | 3/2013 | Somei | F21V 13/04 362/145 |
| 2013/0284234 | A1 * | 10/2013 | Funayama | H02S 30/20 136/245 |
| 2013/0285580 | A1 * | 10/2013 | Mullet | E06B 9/72 318/139 |
| 2014/0008027 | A1 * | 1/2014 | Mullet | H02P 3/08 160/310 |
| 2014/0076508 | A1 * | 3/2014 | Mullet | A47H 1/02 160/310 |
| 2014/0262061 | A1 * | 9/2014 | Stawski | E04F 10/0666 160/66 |
| 2015/0034259 | A1 * | 2/2015 | Bohlen | E06B 9/62 160/310 |
| 2015/0179994 | A1 * | 6/2015 | Lemaitre | E06B 9/68 160/310 |
| 2015/0362896 | A1 | 12/2015 | Feldstein | |
| 2017/0081917 | A1 | 3/2017 | Brunk | |
| 2017/0101820 | A1 | 4/2017 | Slivka | |
| 2017/0191273 | A1 | 7/2017 | Eilam | |
| 2017/0275884 | A1 * | 9/2017 | Thompson | E04F 10/0692 |

FOREIGN PATENT DOCUMENTS

| | | | | |
|---|---|---|---|---|
| FR | 2808047 | A1 * | 10/2001 | E04F 10/0666 |
| FR | 2908436 | A1 * | 5/2008 | E04F 10/0666 |
| FR | 2939182 | | 4/2010 | |
| JP | 2015025270 | | 2/2015 | |
| KR | 20110114944 | | 10/2011 | |

OTHER PUBLICATIONS

Woo, KR 20110114944 machine translation, retrieved from https://worldwide.espacenet.com/publicationDetails/biblio?CC=KR&NR=20110114944A&KC=A&FT=D&ND=3&date=20111020&DB=&locale=en_EP (Year: 2011).*

* cited by examiner

CONTROL DEVICE FOR THE LIGHTING ELEMENTS TO BE MOUNTED ON A ROLLER COVERING INSTALLATION

FIELD OF THE INVENTION

The present invention relates to a control device for lighting elements of a roller covering installation, in particular a roller shade, preferably but not necessarily motorized.

BACKGROUND OF THE INVENTION

Roller shades are known of the type comprising a canvas, which in the retracted shade condition is rolled on a tubular shaft and in outspread shade condition is unrolled from said shaft and is kept taut by its constraint on one side to said tubular shaft and on the opposite side to a rigid crosspiece which can be moved towards and away from the tubular shaft itself.

In the case of overhanging awnings, the rigid crosspiece is connected to the support structure of the tubular shaft by means of a pair of articulated arms, whereas in the case of sliding awnings, the rigid crosspiece slides with ends along two fixed parallel guides placed at the sides of the surface to be covered by the outspread shade.

In the case of overhanging awnings, the rigid crosspiece may also be shaped so as to cover the shade, when it is rolled about the tubular shaft, and thus form a sort of protective box, which in this case is known as a box shade.

Regardless of the type of shade, the drive for rolling the canvas on the tubular shaft and unrolling it from the tubular shaft is achieved with a conventional electric motor tubular element inserted inside the rolling shaft which can be controlled, preferably wirelessly, directly by the user or by light and/or wind sensors. This solution is, for example, described in the roller coverings described in AU 2014 200269, US2015/362896 and US2017/101820.

The market currently requires to equip roller shades with lights which may be used to illuminate the surface beneath the shade and/or form courtesy lights and/or create light effects, in particular RGB effects.

Until today, this need was met in articulated arm awnings by applying these lights, preferably LEDs, to the arms themselves and/or to the rigid crosspiece and/or to the support structure of the shade, and in sliding awnings by applying these lights to the guides and/or the supporting uprights of the guides and/or to other parts of the support structure of the shade.

All this also implies the need to make a lighting system with dedicated components which, together with the lights themselves, must be applied to the support structure of the shade. In particular, a power supply and control unit of the lights must be provided, which in known solutions is either external or inserted into one of the supporting uprights of the shade, if provided. These are solutions have some degree of installation complexity and are surely unsatisfactory, particularly in the case of shades with articulated arms and therefore free from uprights.

In this respect, for example KR 2011 0114944 describes a motorized roller shade which has a covering canvas with a flap associated with a roller while the other flap is associated with a rigid crosspiece; moreover, guide arms interposed between a rectangular section bar and said rigid crosspiece are provided. Lighting elements are mounted at the bottom of the rectangular section bar, of the guide arms and of the rigid crosspiece. A first bracket is also provided to secure the rolling roller to the rectangular section bar and a second bracket is provided to fix the latter to the wall. Furthermore, both the rectangular section bar and the rolling roller—together with a battery, an inverter and the control unit, which are fixed to the outer end of said rolling roller—are all accommodated inside a containment section which is substantially "C"-shaped and which, in particular, is open outwards to allow the unrolling of the canvas and the translational movements of the guide arms. A plurality of photovoltaic cells is mounted to the outer upper surface of the containment section to generate electric energy to be stored in a corresponding battery (also accommodated in said section, at one of its ends) and then to be used to supply power to the lighting elements.

This known solution is not entirely satisfactory because it requires the use of a specially shaped, oversized section in order to accommodate all the components inside and, in particular, to contain the assembly—comprising battery, inverter and control unit—which protrudes from the outer end of the rolling roller.

Tubular motors provided with an output for supplying power to lights and motors in which the power supply unit of the lights is integrated in the motor itself have also been suggested. This solution in practice has eliminated at least in part the difficulty of installation of the lighting system but has some limitations because the lights are supplied at low voltage (12 or 24 Vdc) and the power supplied from the light output of the motor can only supply power to a small amount/number of lights.

SUMMARY OF THE INVENTION

It is the object of the invention to suggest a device for controlling lighting elements of a roller covering installation, preferably a roller shade, which eliminates all the drawbacks encountered in the known solutions.

It is another object of the invention to suggest a device which is easy to be installed, even by unskilled personnel.

It is another object of the invention to suggest a device which is easy to be programmed and managed.

It is another object of the invention to suggest a device which is independent and autonomous and/or additional with respect to the drive unit of the roller covering installation.

It is another object of the invention to suggest a device which can also be used in combination with photovoltaic panels.

It is another object of the invention to suggest a device which can be remotely controlled via mobile phone both for controlling the actuation of the control device itself and to check the correct execution of the received controls.

It is another object of the invention to suggest a device which improves the traditional ones and/or is alternative thereto.

It is another object of the invention to suggest a device which is simple and quick to be obtained at low cost.

It is another object of the invention to suggest a roller covering installation, in particular a roller shade, which is provided with a device for controlling the lighting elements of said covering and which is easy to be installed, easy to be programmed and managed, obtainable in a simple and quick manner and at low cost.

All these objects, considered individually or in any combination, and others which will become apparent from the following description are achieved, according to the invention, by a control device of the lights of a roller covering installation, in particular of a roller shade, preferably motorized according to the invention, and by a roller covering installation, preferably a roller shade according to according to the invention.

BRIEF DESCRIPTION OF THE DRAWINGS

The present invention is further explained by means of some preferred embodiments given by way of non-limiting example only with reference to the accompanying drawing, in which.

DETAILED DESCRIPTION OF THE INVENTION

Figure 1:
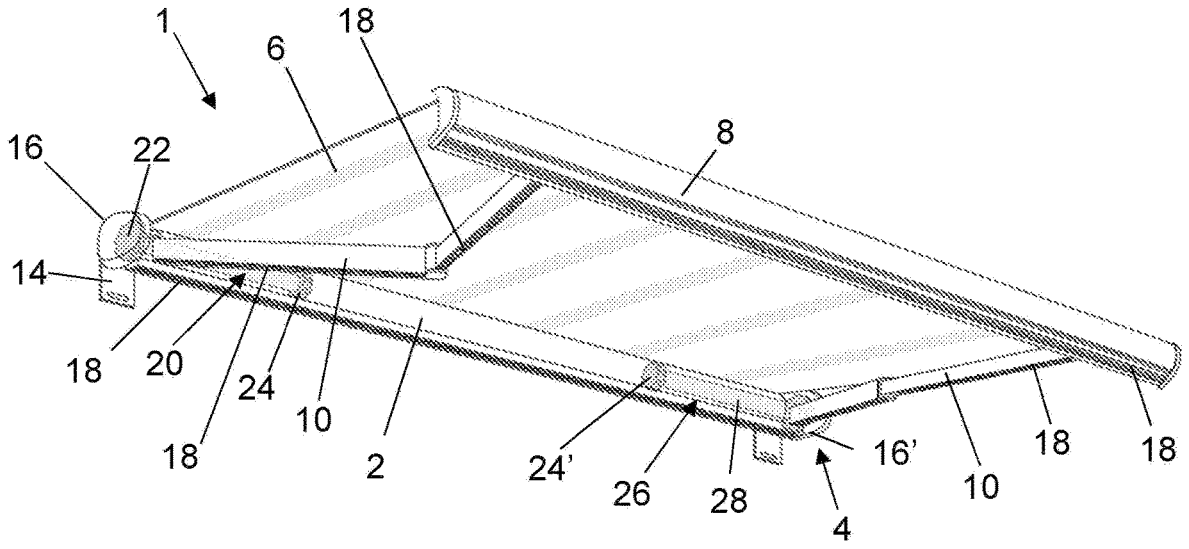
FIG. 1 is a perspective view from below of a motorized roller shade provided with control device of the lighting elements according to the invention.
Figure 2:
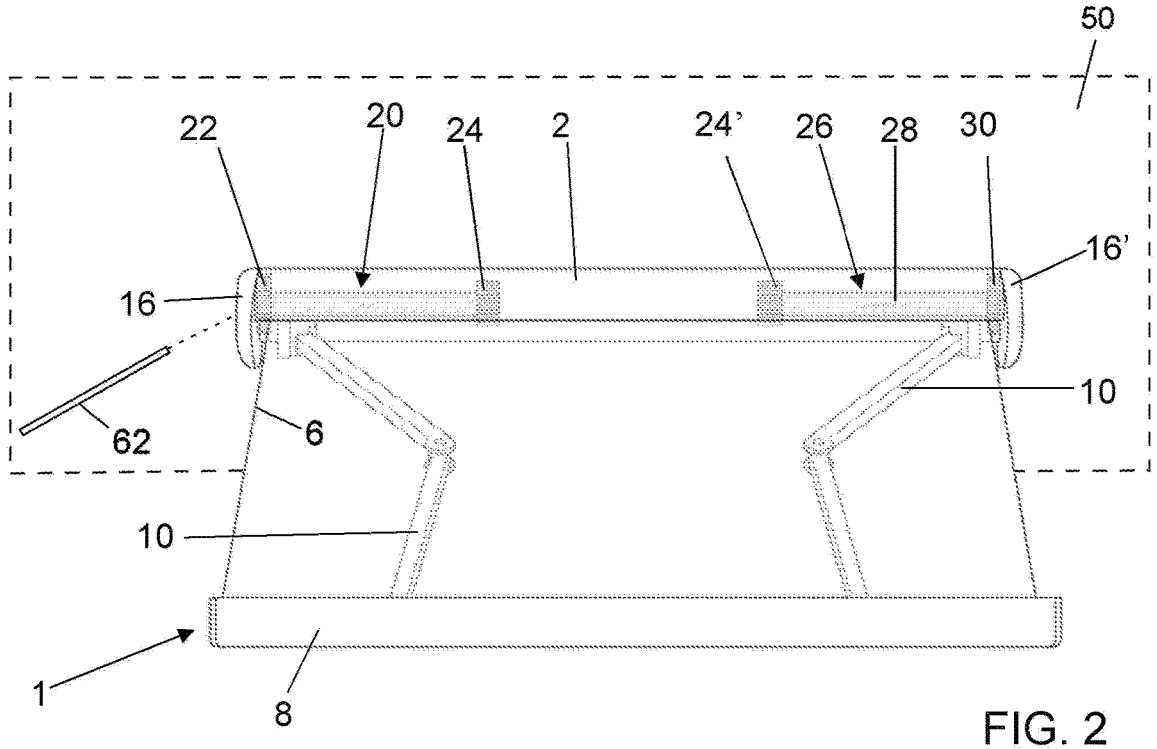
FIG. 2 is a partially sectional, perspective top view.
Figure 3:
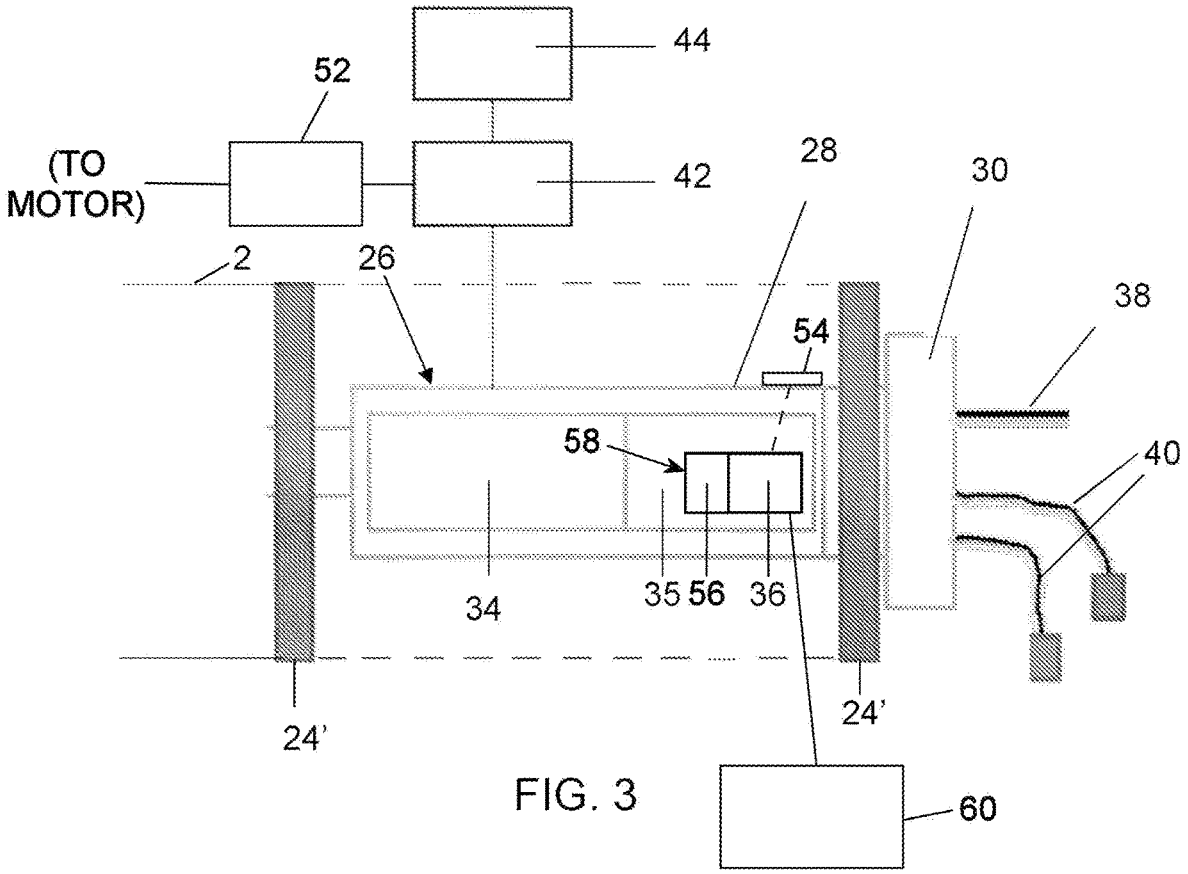
FIG. 3 is a diagrammatic longitudinal section.
Figure 4:
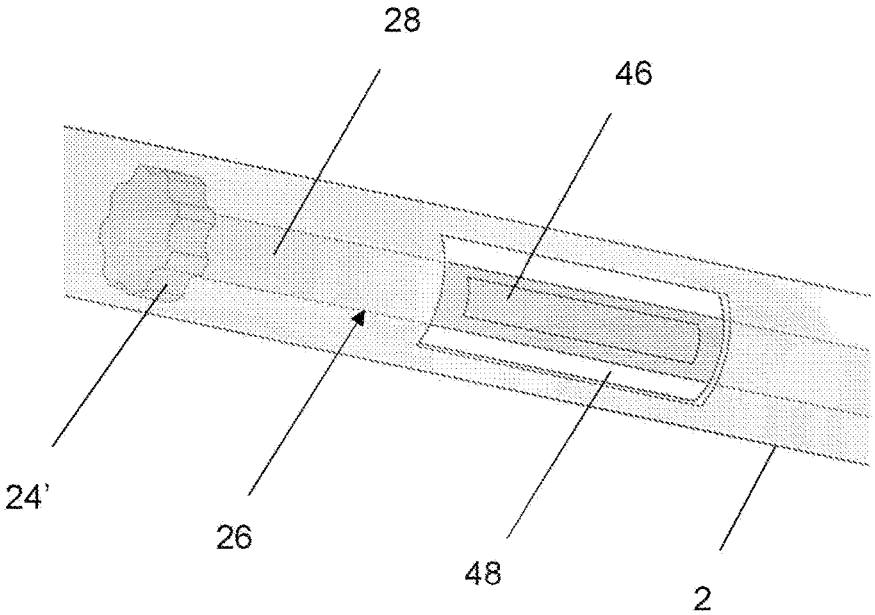
FIG. 4 is a diagrammatic perspective view of a detail of the control device according to the invention inserted into the tubular shaft of the shade.

As it can be seen from the figures, the device according to the invention, indicated as a whole by reference numeral 26, for controlling the lighting elements 18 is applied/mounted, in the example shown, to a roller covering installation, in particular a roller shade, indicated as a whole by reference numeral 1.

Preferably, the roller shade 1 is of a conventional type. Preferably, the roller shade 1 is motorized but could also be actuated manually. In particular, the roller shade 1 is of the type with articulated arms, i.e. of the type which comprises a tubular shaft 2, a support structure 4 of the tubular shaft 2, a canvas 6, which can be rolled around the tubular shaft 2 and unrolled therefrom, a rigid crosspiece 8, to which the edge of the canvas 6 is applied opposite to that coupled to the tubular shaft 2, and two pair of articulated arms 10, which connect the rigid crosspiece 8 to the support structure 4 and guide it in its translational movements with respect thereto.

Appropriately, the canvas 6 can be rolled/unrolled along a substantially vertical direction and along a direction more or less inclined relative to the vertical.

The tubular shaft 2 can be, for example, a metal shaft which conveniently, can have any cross section. Preferably, the tubular shaft 2 may have a circular or polygonal section, e.g. hexagonal, octagonal or the like. Appropriately, the tubular shaft 2 is of the type traditionally used for shades and/or for roller blinds.

Preferably, the support structure 4 may comprise:

a rigid metal band, which appropriately adheres to a fixed structure, e.g. to a wall of a building, a first pair of brackets 14 for fixing the rigid band to the fixed structure, and a second pair of brackets 16, 16', preferably wing-shaped, which extend from said rigid strip outward and which appropriately support the ends of the equipped tubular shaft 2 which is advantageously provided with all the components needed for its correct operation, as will be described in greater detail below.

Conveniently, the canvas 6 can be of any conventional type and requires no further explanation.

Conveniently, the rigid crosspiece 8 may consist of a metal or plastic section bar piece and may have any cross-section. Preferably, the rigid crosspiece 8 is shaped so that when the shade is in rolled condition, it adheres to the support structure 4 and forms a sort of container or box therewith, which accommodates the tubular shaft 2, the canvas 6 rolled thereon and the articulated arms 10, which are located in folded condition, inside.

Appropriately, lighting elements 18 are mounted to the roller shade 1. Advantageously, the lighting elements 18 can be mounted to any component of the roller shade 1 and in any position. More in particular, the lighting elements 18 can be mounted to the support structure 4 and/or on the articulated arms 10 and/or on the rigid crosspiece 8 and/or on the tubular shaft 2 and/or also on the canvas 6. Preferably, the lighting elements 18 are mounted to the rigid elements of the roller shade 1, such as the support structure 4 and/or the articulated arms 10 and/or the tubular shaft 2 and/or the rigid crosspiece 18.

Advantageously, as described in greater detail below, the lighting elements 18 are connected—preferably by means of electric conductor cables/wires—to the control device 26 accommodated in the tubular shaft 2. Preferably, the electric conductor cables run inside the components of the roller shade 1 and therefore are hidden from sight from the outside.

Advantageously, the lighting elements 18 are light sources and, preferably, are LED strips which define sources of monochromatic and/or RGB light.

In particular, the lighting elements 18 consist of at least one LED strip which includes a set of LED diodes, i.e. electronic components which emit light if powered by electricity. Appropriately, the LED diodes are fixed—preferably by soldering—onto a printed circuit board (PCB), preferably flexible, which performs the function of support and electric connection. Advantageously, the LED diodes of the LED strip may be configured to emit monochromatic light or may be of the RGB type.

Advantageously, in the example shown in the figures, the lower edge of the support structure 4, the lower edge of the articulated arms 10 and the lower edge of the rigid crosspiece 8 are fitted with LED strips 18 which globally form diffused monochromatic light or RGB light sources and are connected to the control device 26 accommodated in the tubular shaft 2 via electric conductor cables running inside the rigid crosspiece 8 and the articulated arms 10 and/or the other rigid components of the roller shade 1.

Appropriately, the roller shade 1 comprises means configured to cause the rotation in the two directions of the tubular shaft 2, whereby making it possible to roll and unroll the covering canvas 6 having a flap fixed to said shaft.

Advantageously, a drive unit is inserted into the tubular shaft 2 to cause the rotation of the shaft itself in the two directions. Preferably, this drive unit is inserted inside the tubular shaft 2 at a first end thereof. Preferably, the unit comprises a conventional tubular, electric driving/feeding motor 20, preferably of the asynchronous, single-phase type, inserted into the tubular shaft itself. Preferably, said unit further comprises means (e.g. a battery) for supplying said electric motor and a control unit of said motor.

In greater detail, the motor 20 is appropriately provided with a motor head 22 which is appropriately fixed by means of any known system to the support structure 4, preferably is fixed to the wing-shaped bracket 16 of the latter. The tubular motor 20 is also provided with an output pinion to which a feeding adapter 24 (pulley) of the tubular shaft 2 is coupled, cooperating in a traditional manner with a similar idle adapter 14", which is mounted near said head 22.

Alternatively, means may be provided—which may be manually actuated, configured to cause the rotation of the tubular shaft 2 in the two directions. Conveniently, these means configured to cause the rotation of the tubular shaft 2 in the two directions may consist of a conventional winch 62 operated by hand or by means of an electric motor applied thereto.

The device 26 for controlling the lighting elements 18 is also inserted inside the tubular shaft 2. Preferably, this device 26 is inserted at the other end of the tubular shaft 2.

Preferably, the drive unit of the shaft itself is inserted and accommodated at one end of the tubular shaft 2, while the control device 26 of the lighting elements 18 mounted to at least one component of the installation of the roller covering 1 is inserted and accommodated at the other end of the tubular shaft 2.

Appropriately, therefore, the control device 26 of the lighting elements 18 is substantially independent and autonomous—both from the point of view of construction and positioning both from the point of view of operation—with respect to the drive unit of the installation of the roller covering.

Advantageously, the control device 26 comprises a preferably tubular casing 28, which is removably inserted inside the tubular shaft 2.

Preferably, the casing 28 is appropriately applied a constraining head 30 to the other wing-shaped bracket 16' of the support structure 4, and a pair of adapters 24'.

Advantageously, the adapters 24' for supporting the casing 28 inside the shaft itself are interposed between the casing 28 and the tubular shaft 2. Preferably, a pair of supporting adapters 24', which are interposed between the opposite sides of the tubular casing 28 and the tubular shaft 2, are provided.

Preferably, head 30 and adapters 24' have a similar shape to that of head 22 and adapters 24 of the tubular motor 20, but unlike them have the sole function of idly supporting the tubular shaft 2 at its end opposite to that of insertion of said motor 20.

Appropriately, it is understood that the shape and the size of the tubular casing 28 are not linked to those of the tubular shaft 2, while being apparently compatible therewith. In particular, the shape and size of the tubular casing 28 are adapted to allow it to be inserted and accommodated inside the tubular shaft 2. Appropriately, the positioning stability of the tubular casing 28 inside the tubular shaft 2 is achieved by means of the adapters 24'.

Appropriately, the control device 26 according to the invention comprises a power supply 34, a control unit 35 and a receiver 36 which is connected to or incorporated in said unit.

Advantageously, the power supply 34 for lighting elements 18 is accommodated inside the tubular casing 28.

Advantageously, the control unit 35 (e.g. a processor) which is connected to an output interface 40 provided outside the tubular body 28 and connected, in turn, to the lighting elements 18 is also accommodated inside the tubular casing 28. Appropriately, the connection between the control unit 35 (accommodated inside the casing 28, and the inside of the tubular shaft 2 as a consequence) and the output interface 40 (positioned outside the tubular shaft 2), as well as between the latter and the lighting elements 18 is achieved by means of electric signal conductor and transmission cables.

Preferably, the control/communication drivers with the output interface 40 connected to the lighting elements 18 are implemented in the control unit 35.

Preferably, the receiver 36 is also provided inside the tubular casing 28, which receiver is connected, wirelessly and/or wired, with the outside of said roller covering 1 to receive control signals for controlling said lighting elements 18 from the outside accordingly.

Advantageously, the receiver 36 is of a wireless type. Conveniently, by means of the receiver 36, the controller itself 35 may receive control signals of the lighting elements 18 from an external transmitter, and in particular from a remote control or even from a mobile phone or from other traditional wireless devices in general. Appropriately, for this purpose, the receiver 36 is connected to and/or incorporated in the electronic circuit of the control unit 35 to be operatively connected to the control/communication driver of the output interface 40 connected to the lighting elements 18.

Advantageously, the receiver 36 can be wirelessly connected to light, wind and/or rain sensors 54.

The receiver 36 can be advantageously replaced by a transceiver 58, preferably wireless, which in addition to sending corresponding control signals to the lighting elements 18 can communicate the status of the elements themselves remotely, for example, to a remote terminal 60, and, preferably, also the operating parameters or the presence of any faults or malfunctions. In particular, for this purpose, the transceiver, in addition to controlling/communicating with its receiver side with the output interface 40 connected to the lighting elements 18, can transmit status signals of the lighting elements 18 themselves with the transmitter side, for example, using a wireless transmitter 56. So, both substantially and conveniently, the user can remotely control, e.g. via a mobile phone (preferably a smartphone), the switching on and off and the adjustment of the lighting elements 18 and can receive, information on their current status again with the mobile phone (preferably a smartphone). Appropriately, the transceiver is connected to and/or incorporated in the electronic circuit of the control unit 35 to be operatively connected to the control/communication driver of the output interface 40 connected to the lighting elements 18.

Advantageously, the power supply 34 accommodated in the tubular casing 28 can be supplied from the outside, preferably it is supplied directly by means of a cable 38 connected to an external electric source (preferably to the network) and therefore in practice without any limitation of power which can be supplied and therefore of the quantity/number of lighting elements 18 which can be supplied.

However, alternatively, the power supply 34 accommodated in the tubular casing 28 may be supplied by one or more batteries 42 which, preferably, are rechargeable with one or more external photovoltaic panels 44 which can be conveniently mounted to the covering installation 1 and/or may be outside it and independent therefrom.

The rechargeable battery 42 can be advantageously accommodated inside the tubular casing 28.

Advantageously, on the side wall of the tubular casing 28 a first flap 46 is provided to access the inside of the tubular casing itself from the outside, e.g. to be able to access the rechargeable battery 42, if provided. Advantageously, a second flap 48 for accessing the first flap 46 obtained in the tubular casing 28 may also be provided in the tubular shaft 2. Appropriately, it is understood that the first flap 46 of the tubular casing 28 and the second flap 48 of the tubular shaft 2 face each other. Obviously, in the example shown in the figures, this accessibility requires the device 26 to be correctly inserted inside the tubular shaft 2 and the shade to be outspread, i.e. the canvas 6 to be unrolled from the tubular shaft 2 and not cover the flap 48.

Advantageously, the rechargeable battery 42 itself can also supply power to the motor 20, preferably by means of an inverter 52, also accommodated inside the tubular casing 28. Conveniently, in this case, the entire shade 1 may also be installed in places where a network supply is not available. Advantageously, however, the motor 20 may be supplied by means of a low-voltage external power supply, again by means of an inverter.

From the above, it is apparent that the device according to the invention, for controlling the lighting components mounted to a covering installation, is very advantageous, and in particular:

by virtue of its integration in the tubular casing 28, it is quite simple and quick to be installed, because it only requires inserting the tubular casing 28 into the tubular shaft 2, constraining the shaft thus equipped to the support structure 4 and connecting the device 26 to the light sources and, if provided, to the external network supply, it defines a mechanical connection element between the tubular shaft 2 and the fixed support structure 4, for example, outer fixed structure 50, there is practically no limit to the electric power which can be supplied and therefore it can supply and control even a large number of lighting elements, if photovoltaic panels 44 are used, the control device and more generally the entire shade is independent from the external electric network, it makes it possible to accommodate the rechargeable battery 42 inside the tubular casing 28, whereby further simplifying the installation of the device and in particular eliminating the fixed external batteries.

In particular, the present invention differs from AU 2014 200269, US2015/362896 and US2017/101820 because the latter relate to a roller covering installation without lighting elements mounted to the components of the cover itself. Furthermore, A U 2014 200269, US2015/362896 and US2017/101820 teach, at the most, to insert the tubular motor with its supply and with its control unit inside the tubular shaft.

Additionally, unlike KR 0114944 2011, the present invention relates to a roller installation which is provided with lighting elements mounted to at least one of the components of said cover and wherein the power supply, control unit lighting elements, as well as the wireless receiver, are arranged inside a casing which can be removably inserted and accommodated in the tubular shaft about which the covering is rolled.

The device according to the present invention was described with particular reference to its application in a roller shade 1, but it is understood that it can be applied to any roller covering installation, either vertical or inclined, such as shutters, roller blinds or even sectional doors.

The invention claimed is:

1. A roller covering installation, onto which lighting elements are mounted, the roller covering installation comprising:

a support structure configured to constrain the roller covering installation to an outer fixed structure;

a tubular shaft supported by the support structure, the tubular shaft having first and second ends and being rotatable in at least one of two directions;

a covering to be rolled on the tubular shaft and to be unrolled therefrom;

a plurality of the lighting elements applied to at least one component of the roller covering installation; and a control device configured to control the lighting elements, the control device comprising a tubular casing that is entirely tubular and that is inserted and accommodated in the tubular shaft, wherein there are arranged inside the tubular casing:

a power supply for the lighting elements;

a control unit for the lighting elements, the control unit being connectable wirelessly or with wires to the lighting elements of the roller covering installation; and a receiver connected to or incorporated in the control unit and configured to receive control signals from outside to control the lighting elements, and wherein the tubular casing is provided with means for idly supporting the tubular shaft at the second end of the tubular shaft, said means comprising, adapters disposed in the tubular shaft at first and second ends of the tubular casing and interposed between the tubular casing and the tubular shaft, the adapters idly supporting the tubular casing inside the tubular shaft, and a head associated with the tubular casing, the head constraining the tubular casing to the support structure, wherein a drive unit configured to cause a rotation in each of the two directions of the tubular shaft is inserted and accommodated inside the tubular shaft at the first end of the tubular shaft, and wherein the control device of the lighting elements is inserted and accommodated inside the tubular shaft at the second end of the tubular shaft.

2. The roller covering installation according to claim 1, wherein the roller covering installation is motorized.

3. The roller covering installation according to claim 1, wherein the lighting elements are electrically connected to the control device accommodated in the tubular shaft by electric conductor cables running inside one or more of the support structure, the tubular shaft, a crosspiece of the roller covering installation, or a system guiding translational movements of the crosspiece with respect to the support structure.

4. The roller covering installation according to claim 3, wherein the control device of the lighting elements is constructed, positioned, and operable to be independent and autonomous from an actuator of the roller covering.

5. The roller covering installation according to claim 1, wherein the tubular casing of the control device is configured to be removably and fully inserted and accommodated inside the tubular shaft.

6. The roller covering installation according to claim 1, wherein the control device further comprises an output interface positioned outside the tubular casing and outside the tubular shaft, the output interface being connected to the control unit and to the lighting elements.

7. The roller covering installation according to claim 6, wherein the control device further comprises drivers of control/communication with the output interface that are implemented in the control unit.

8. The roller covering installation according to claim 1, wherein the receiver arranged inside the tubular casing of the control device is incorporated in or connected to an electronic circuit of the control unit.

9. The roller covering installation according to claim 1, wherein the control device further comprises a cable for connection to an external electric power network.

10. The roller covering installation according to claim 1, wherein the control device further comprises a rechargeable battery for supplying power to the control device, the battery being accommodated inside the tubular casing.

11. The roller covering installation according to claim 1, wherein the control device further comprises an inverter that is accommodated inside the tubular casing for supplying power from an external, low-voltage supply to a motor positioned at the first end of the tubular shaft and configured to cause a rotation of the tubular shaft.

12. The roller covering installation according to claim 11, wherein said receiver comprises a wireless receiver that is accommodated inside the tubular casing for remotely controlling the lighting elements and/or the motor configured to cause the rotation of the tubular shaft.

13. The roller covering installation according to claim 12, wherein the receiver arranged inside the tubular casing of the control device is wirelessly connected to a light, wind, or rain sensor.

14. The roller covering installation according to claim 12, wherein the control device further comprises a wireless transmitter that is also accommodated inside the tubular casing to indicate a status of the lighting elements and/or the motor.

15. The roller covering installation according to claim 14, wherein one or both of the wireless receiver or the wireless transmitter are arranged to communicate wirelessly with a remote terminal.

16. The roller covering installation according to claim 14, wherein the wireless receiver and the wireless transmitter are implemented in a wireless transceiver accommodated in the tubular casing.

17. A roller covering installation, onto which lighting elements are mounted, the roller covering installation comprising:

a support structure configured to constrain the roller covering installation to an outer fixed structure;

a tubular shaft supported by the support structure, the tubular shaft having first and second ends and being rotatable in at least one of two directions;

a covering to be rolled on the tubular shaft and to be unrolled therefrom;

a plurality of the lighting elements applied to at least one component of the roller covering installation; and a control device configured to control the lighting elements, the control device comprising a tubular casing that is entirely tubular and that is inserted and accommodated in the tubular shaft, wherein there are arranged inside the tubular casing:

a power supply for the lighting elements;

a control unit for the lighting elements, the control unit being connectable wirelessly or with wires to the lighting elements of the roller covering installation; and a receiver connected to or incorporated in the control unit and configured to receive control signals from outside to control the lighting elements, and wherein the tubular casing is provided with means for idly supporting the tubular shaft at a second end of the tubular shaft, said means comprising, adapters disposed in the tubular shaft at first and second ends of the tubular casing and interposed between the tubular casing and the tubular shaft, the adapters idly supporting the tubular casing inside the tubular shaft, and a head associated with the tubular casing, the head constraining the tubular casing to the support structure, wherein a drive unit configured to cause a rotation in each of the two directions of the tubular shaft is inserted and accommodated inside the tubular shaft at the first end of the tubular shaft, and wherein the control device of the lighting elements is inserted and accommodated inside the tubular shaft at the second end of the tubular shaft, and wherein the control device further comprises a first flap that provides access to the tubular casing from outside, the first flap being provided on a side wall of the tubular casing and being incorporated in the tubular casing so as to face, at least in part, a second flap incorporated in the tubular shaft, the first flap being positioned between the adapters disposed in the tubular shaft at the first and second ends of the tubular casing.

18. A roller covering installation, onto which lighting elements are mounted, the roller covering installation comprising:

a support structure configured to constrain the roller covering installation to an outer fixed structure;

a tubular shaft supported by the support structure, the tubular shaft having first and second ends and being rotatable in at least one of two directions;

a covering to be rolled on the tubular shaft and to be unrolled therefrom;

a plurality of the lighting elements applied to at least one component of the roller covering installation; and a control device configured to control the lighting elements, the control device comprising a tubular casing that is entirely tubular and that is inserted and accommodated in the tubular shaft, wherein there are arranged inside the tubular casing:

a power supply for the lighting elements;

a control unit for the lighting elements, the control unit being connectable wirelessly or with wires to the lighting elements of the roller covering installation; and a receiver connected to or incorporated in the control unit and configured to receive control signals from outside to control the lighting elements, and wherein the tubular casing is provided with means for idly supporting the tubular shaft at the second end of the tubular shaft, said means comprising, adapters disposed in the tubular shaft at first and second ends of the tubular casing and interposed between the tubular casing and the tubular shaft, the adapters idly supporting the tubular casing inside the tubular shaft, and a head associated with the tubular casing, the head constraining the tubular casing to the support structure, wherein a drive unit configured to cause a rotation in each of the two directions of the tubular shaft is inserted and accommodated inside the tubular shaft at the first end of the tubular shaft, and wherein the control device of the lighting elements is inserted and accommodated inside the tubular shaft at the second end of the tubular shaft, wherein the control device of the lighting elements is substantially independent and autonomous, relative to its construction and positioning as well as its operation, with respect to the drive unit configured to rotate the tubular shaft in each of the two directions.

* * * * *